United States Patent [19]

Morikawa

[11] 4,324,199

[45] Apr. 13, 1982

[54] DEVELOPING DEVICE

[75] Inventor: Teruo Morikawa, Tokyo, Japan

[73] Assignee: Canon Kabushiki Kaisha, Tokyo, Japan

[21] Appl. No.: 121,658

[22] Filed: Feb. 15, 1980

[30] Foreign Application Priority Data

Feb. 20, 1979 [JP] Japan ..... 54/19303

[51] Int. Cl.[3] ..... G03G 15/09

[52] U.S. Cl. ..... 118/658; 118/653; 118/657; 355/3 DD

[58] Field of Search ..... 118/653, 657, 658, 246, 118/258; 355/3 DD

[56] References Cited

U.S. PATENT DOCUMENTS 3,953,121 4/1976 Reichart, Jr. ..... 118/658 X

OTHER PUBLICATIONS

Williams, E. M., *Mechanically Compliant (Self-Adjusting) Developer Unit, IBM Technical Disclosure Bulletin,* vol. 19, No. 10, Mar. 1977, pp. 3865-3867.

*Primary Examiner*—Evan K. Lawrence

*Attorney, Agent, or Firm*—Fitzpatrick, Cella, Harper & Scinto

[57] ABSTRACT

A developing device has a rotatable developer holding cylinder and a developing device box for supporting the developer holding cylinder. The developing device box is freely suspended by a holding device, and pressure is resiliently applied to the cylinder so that the cylinder is maintained at a predetermined close distance with respect to a rotatable image bearing member. The position at which the developing device box is suspended is set to a position at which a force component of the driving force transmitting the rotational movement of the image bearing member to the developer holding cylinder acts in a direction in which the cylinder moves away from the image bearing member.

17 Claims, 3 Drawing Figures

FIG. 1
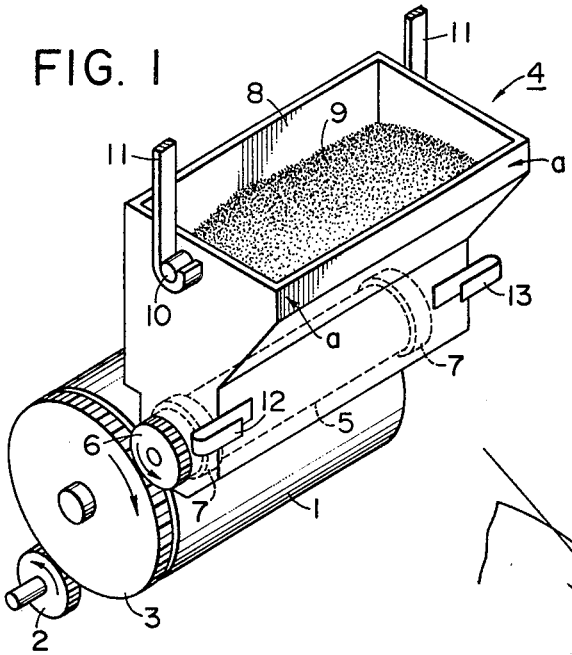
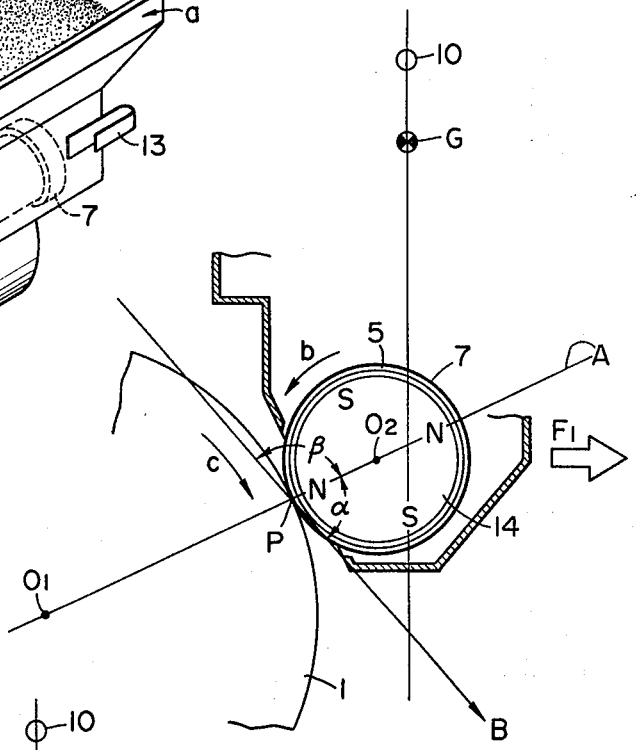
FIG. 2
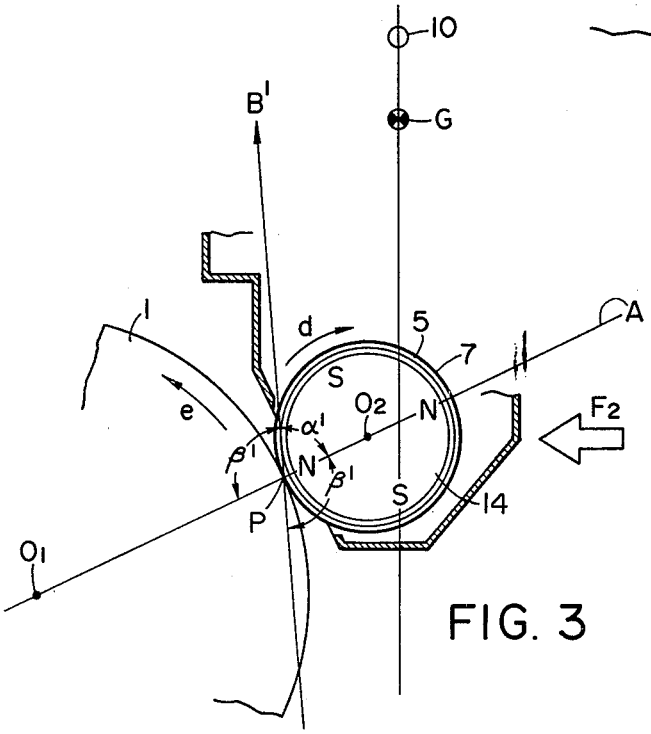
FIG. 3

DEVELOPING DEVICE

BACKGROUND OF THE INVENTION

1. Field of the Invention

This invention relates to a developing device for developing the electrostatic latent image or the magnetic latent image on an image bearing member into a visible image.

2. Description of the Prior Art

The image formation apparatus with which the present invention is concerned is, for example, an electrostatic copying machine. As is well-known, this machine is such that original information is imaged on a photosensitive drum by optical means to form an electrostatic latent image on the photosensitive medium, where after the latent image is visualized by means of developing powder called toner, the visualized image is transferred to copy paper, and the toner on the copy paper is then fixed to thereby obtain a copy image. There is also known the so-called TES1 system whereby an electrostatic latent image formed on a photosensitive medium is transferred to an insulating member and thereafter the transferred image is developed; or the screen system whereby a secondary latent image is formed by the use of a screen-like photosensitive medium and by ion modulation; or the electrofax system whereby an electrostatic latent image is formed directly on copy paper having a photoconductive layer on its surface and such image is subjected to the developing and fixing treatments to thereby obtain a copy image.

The general developing device is such that a non-magnetic cylinder with toner deposited on the surface thereof (hereinafter referred to as the sleeve) is disposed in proximity to the photosensitive drum and the toner deposited on the sleeve is brought into friction contact with the surface of the photosensitive drum on which the electrostatic latent image rests, to thereby visualize the latent image. In this case, generally, there is a sufficient gap between the photosensitive drum and the sleeve and the gap tolerance does not so much adversely affect the image formation. Accordingly, the developing device is usually placed on and fixed to a developing device mounting member which is usually provided separately. Also, where the toner layer on the sleeve is relatively thin and the gap is small, it is required that the thickness of the toner layer portion brought into friction contact with the drum surface or the width of the nip portion be uniform, and this has heretofore been accomplished by the fixed mounting method as described above.

However, according to such mounting method, there is naturally caused a cumulative error which is attributable to the mechanical dimensional accuracy and in the case of a developing method having a relatively thin toner layer, there is a disadvantage that the dimension of the gap between the drum and the sleeve becomes different from machine to machine due to said cumulative error of each machine and the resultant image, especially the density, becomes irregular.

To eliminate these inconveniences, the applicant has proposed, U.S. patent application Ser. No. 938,101, abandoned, a method in which gap maintaining members are provided at the opposite ends of the sleeve and the sleeve is urged against the photosensitive drum with such gap maintaining members interposed therebetween. According to this method, the gap between the photosensitive drum and the sleeve is maintained always constant by the gap maintaining members, thus eliminating the above-mentioned inconveniences.

Now, in order that the sleeve may be urged against the photosensitive drum with the gap maintaining members interposed therebetween, the following conditions must be satisfied:

(i) The urging pressure must be minimized to the necessary minimum level so that damage and an excessive load are not imparted to the photosensitive drum; and (ii) When the sleeve is rotatively driven by drive means secured to the photosensitive drum, said urging pressure must not be increased too much or fluctuated by the drive force.

SUMMARY OF THE INVENTION

It is an object of the present invention to provide an improved novel developing device.

It is another object of the present invention to provide a developing device in which the gap between the image bearing member and the sleeve is maintained constant.

It is still another object of the present invention to provide a developing device which is designed so as not to impart damage to the image bearing member.

It is another object of the present invention to provide a developing device which is designed so as not to impart an overload to the drive source.

It is a further object of the present invention to provide a developing device which is capable of effecting development free of irregularity and fog by using a one-component developer.

It is still a further object of the present invention to maintain the very minute gap between the image bearing member and the developer holding cylinder constant when development is effected with toner being caused to jump or being extended.

The present invention which achieves these objects is a developing device for imparting toner to a latent image on an image bearing member to form a visible image which comprises a developer holding cylinder for holding developer on the surface thereof, means for transmitting the rotational drive force of the image bearing member to the developer holding cylinder, a developing device box for supporting the developer holding cylinder, holding means for freely suspending and holding the developing device box, and pressure applying means for resiliently maintaining the cylinder proximate to the surface of the image bearing member. By this, it is possible to maintain the constant between the cylinder and the image bearing member.

Particularly, by setting the position at which the developing device is suspended by said holding means within the area of an obtuse angle formed by a line passing from the center of the image bearing member to the center of the developer holding cylinder and a line of action extending in the direction in which a force acts at the portion of pressure contact between the image bearing member and the cylinder, it is possible to prevent the pressure contact force from becoming excessively great at the portion of contact between the two and thereby avoid, to the utmost, damage imparted to the image bearing member and an excessive load imparted to the drive means of the image bearing member.

The above and other objects and features of the present invention will become more fully apparent from the following detailed description taken in conjunction with the accompanying drawings.

BRIEF DESCRIPTION OF THE DRAWINGS

FIG. 1 is a perspective view of the developing device according to the present invention.

FIG. 2 is a schematic drawing analytically illustrating the force acting on the sleeve.

FIG. 3 is a schematic drawing analytically illustrating the case which is not based on the present invention.

DESCRIPTION OF THE PREFERRED EMBODIMENTS

Preferred embodiments of the present invention will hereinafter be described with reference to the drawings.

Referring to FIG. 1 which is a perspective view of the developing device according to the present invention, the drive input to the photosensitive drum 1 of a copying machine is transmitted from a gear 2 to a drum driving gear 3 integrally formed with the drum 1 and, by this drive force, the photosensitive drum 1 is rotated in the direction of the arrow. The rotational drive force to the developing sleeve 5 of the developing device 4 is transmitted from said drum gear 3 by a gear 6 integrally formed with the sleeve 5. A magnetic roller (not shown) is fixedly disposed within the sleeve 5, and gap holding members 7 such as spacers are provided at the opposite ends of the sleeve 5. Each of these gap holding members 7 may be a thin metal plate such as stainless metal coated with a resin of low friction coefficient such as Teflon, or may be a polyester film or a Teflon resin film. Of course, the gap holding members 7 may be wrapped around the opposite ends of the photo-sensitive drum 1, or may be interposed between the sleeve and the photosensitive drum so as to be taken up by a take-up mechanism. Also, as the spacers, rollers may be provided at the opposite ends of the sleeve and such rollers may be integral with the sleeve, but if the rollers are designed so as to be freely movable relative to the sleeve, no unreasonable force will be exerted on the portion of pressure contact between the rollers and the photosensitive medium. In FIG. 1, there is shown an example in which the spacers 7 are provided within the box of the developing device, but the spacers 7 may preferably be provided outside of the developing device box 8 to prevent adherence of toner.

In this embodiment, the developing device box 8 is such that the portion thereof above the sleeve 5 provides a hopper 8 for storing developer therein, and one-component magnetic toner or two-component developer 9 comprising toner and carrier is supplied to the hopper. Pins 10 for suspending the developing device 4 are provided on the opposite sides of the hopper 8, and the developing device 4 is suspended by support members 11 (installed on the body of the copying machine) which support the pins. It is more desirable for increased stability of installment of the developing device that the position for suspending the developing device 4, namely, the position of the pins, overlie the center of gravity of the entire developing device including the sleeve.

At this time, the sleeve 5 is strongly urged against the photosensitive drum by gravity and the moment of the developing device 4. However, since this force of pressure contact is weak, the gap between the drum and the sleeve is liable to fluctuate. For this reason, springs 12 and 13 attached to the copying machine body (not shown) are urged against the opposite end portions of the developing device box 8 as shown in FIG. 1 so as to urge the sleeve against the photosensitive drum with a suitable pressure contact force. Of course, the pressure contact force may be imparted by other method such as a pulling force applied at a position above the pins 10, for example, the position a in FIG. 1, by springs. Alternatively, the pressure contact force may be imparted directly to the sleeve, instead of to the developing device box.

By doing so, a substantially constant pressure contact force acts between the drum and the sleeve, so that the fluctuation of the gap therebetween is small, thus reducing the possibility of causing irregularity of the image. Particularly, in the case of the toner extension development in which one-component magnetic toner is used and at the position of a magnetic pole, the ears of the toner are erected and extended to effect development or the toner jumping development in which toner is caused to jump from the ends of the ears of the toner to effect development, the gap between the drum and the sleeve is as small as 50 to 500$\mu$, unlike the case of the sleeve development using two component developer in which the gap is of the order of 2 to 8 mm and therefore, it is highly effective to minimize the gap tolerance by the abovedescribed method of the present invention.

Further, when the drive force of the sleeve 5 is received from the drum driving gear 3 by the gear 6, a force is exerted on the meshing portion of the gears in the direction of the line of action of the gear tooth surface and this force acts to separate the sleeve 5 from the drum 1 about the support pins 10 of the developing device 4 of FIG. 1. Accordingly, with such force taken into account, the spring 12 must be made stronger than the spring 13. Such condition is analytically shown in FIG. 2. In FIG. 2, the gap holding member 7 is provided outside of the sleeve 5 and a magnetic roller 14 is fixed inside of the sleeve. The sleeve 5 is rotated in the direction of arrow b and contacts the photosensitive drum 1 at the point of contact P, the drum being rotated in the direction of arrow c. The direction B of the drive force applied to the sleeve as a result of its engagement with the rotating drum 1, is inclined by about 20° toward a straight line A passing from the center $O_1$ of the drum to the center $O_2$ of the sleeve, with respect to the tangential direction at the point P, under the influence of the pressure angle of the gears 3 and 6 (FIG. 1). Accordingly, the angle $\alpha$ formed by the straight lines A and B is an acute angle.

Now, when the position for suspending the developing device 4, namely, the position of the pin 10, is set within an area indicated by an angle $\beta$ (obtuse angle) which forms a supplementary angle with the angle $\alpha$, a force component of the drive force in the direction of the straight line B acts in a direction $F_1$ for separating the sleeve from the drum and therefore, the sleeve is not urged so as to eat into the drum, but the balance between this force $F_1$ and the pressure contact force of the spring is maintained and this is very convenient in maintaining the gap constant.

FIG. 3 shows, in contrast with the above-described example, an example which is not based on the present invention. At the point of contact P between the sleeve rotated in the direction of arrow d and the photosensitive drum rotated in the direction of arrow e, a force acts in the direction of straight line $B^1$ due to the drive force. At this time, the pin 10 supporting the developing device of this embodiment lies within an area indicated by an angle $\alpha^1$ formed by straight lines A and $B^1$ and so, the sleeve is subjected to a force in the direction of $F_2$ and is urged so as to eat into the photosensitive drum by such force coupled with the pressure contact force of a spring. Such excessive force may impart damage to the surface of the photosensitive drum or may give an overload to the drive source, and what is more important is that the gap between the drum and the sleeve tends to fluctuate and cause inconveniences such as irregularity of development, fog and the like.

It is therefore preferable that the position for suspending and holding the developing device be set within the area of an obtuse angle $\beta$ (or $\beta^1$) which forms a supplementary angle with the angle $\alpha$ (or $\alpha^1$) of FIG. 2 (or FIG. 3). Also, it is preferable that the aforementioned pin be positioned on or near a perpendicular line overlying the center of gravity G of the developing device and passing through the center of gravity G. This is because, even if the center of gravity is displaced depending on the quantity of the toner in the hopper, the pressure contact force between the sleeve and the drum is not so affected.

In the foregoing description, an example has been shown in which the rotational drive force of the sleeve is taken from the rotational drive gear 3 (FIG. 1) through the gear 6, whereas alternatively, the sleeve may be of such a construction that it does not resort to the intermediary of these gears but follows the drum while being urged against the drum. In that case, the line of action B (or $B^1$) of the drive force becomes approximate to the inclination of the tangential line at the point of contact P, but if the suspending position is set within the area of the obtuse angle $\beta$ as in the above-described example, namely, such that the force acts in the direction in which the sleeve moves away from the drum, it is likewise possible to prevent damages from being imparted to the photosensitive medium by the eating of the spacer into the drum and prevent fluctuation of the gap between the drum and the sleeve.

The image bearing member is not limited to the above-described example but may also be an insulative drum of the type in which a primary electrostatic latent image formed on a screen-like photosensitive medium is ion-modulated to form a secondary latent image, or a magnetic drum on the surface of which a magnetic latent image is formed. Further, the developer holding cylinder may also be one in which, conversely to the above-described embodiment, the sleeve is rotatable and the magnet roll is fixed, or one in which the sleeve and the magnet roller are rotatable with a relative speed difference. Also, this cylinder may be provided only by a magnetic roller.

According to the present invention, as described above in detail, the developing device having a developer holding cylinder is suspended and supported and the developer holding cylinder is urged against the image bearing member by pressure applying means, so that the fluctuation of the gap between the image bearing member and the cylinder is minimized to ensure stable developed images free of development irregularity to be obtained.

Further, the position for suspending and supporting the developing device is set within the area of an obtuse angle, of the angle formed by a straight line passing from the center of the image bearing member to the center of the cylinder, and a straight line extending in the direction in which a force acts at the portion of contact between the image bearing member and the cylinder, so that the force is caused to act in the direction in which the cylinder moves away from the image bearing member and therefore, there occurs no disadvantage that the cylinder is urged against the image bearing member with such an excessive pressure contact force as to eat into the image bearing member, but the gap between the cylinder and the image bearing member is always maintained constant to enable development free of irregularity and fog to be accomplished.

What we claim is:

1. A developing device for imparting toner to a latent image on a rotating image bearing member to form a visible image, comprising:

a rotatable developer holding cylinder for holding developer on a portion of the cylindrical surface thereof;

means for maintaining said surface portion in a predetermined spaced relation with said image bearing member, said maintaining means including pressure applying means for resiliently urging said developer holding cylinder toward said image bearing member for maintaining said predetermined space constant;

engaging means on said cylinder for contacting said rotating image bearing member to provide a drive force for transmitting the rotational movement of said image bearing member to said developer holding cylinder;

a developing device box for supporting said developer holding cylinder; and holding means for freely suspending and holding said developing device box;

wherein the position for said holding means to suspend and hold said developing device box is set within the area of an obtuse angle formed by a line passing from the center of said image bearing member to the center of said developer holding cylinder and a line of action through which said drive force acts at the portion of contact between said image bearing member and said engaging means of said developer holding cylinder.

2. The developing device according to claim 1, wherein the position for said holding means to suspend and hold said developing device box is always above the center of gravity G of the entire developing device.

3. The developing device according to claim 2, wherein the position for said holding means to suspend and hold said developing device box lies on or near a vertical line passing through the center of gravity G of the entire developing device.

4. The developing device according to claim 1, wherein the rotational drive force is transmitted from said image bearing member to said engaging means of said developer holding cylinder by mesh engagement between respective gears provided on said image bearing member and said cylinder.

5. The developing device according to claim 1, wherein said engaging means of said developer holding cylinder comprise radially projecting opposite end portions thereof, and wherein said cylinder receives the rotational drive force from said image bearing member by contact between said opposite end portions and said image bearing member.

6. The developing device according to claim 1, wherein said holding means comprises pins provided at the opposite ends of said developing device box and support reception members provided on an apparatus body.

7. The developing device according to claim 1, wherein said developing device box serves as a hopper for storing developer therein.

8. The developing device according to claim 1, wherein spacers for maintaining constant the space between said developer holding surface of said cylinder and said image bearing member are provided at the opposite ends of said cylinder.

9. The developing device according to claim 1, wherein the opposite ends of said developing device box are subjected to a pressure force by said pressure applying means.

10. The developing device according to claim 9, wherein said engaging means of said developer holding cylinder is disposed at one end of said cylinder, and wherein the pressure force of said pressure applying means is stronger on said one end of said cylinder.

11. The developing device according to claim 1, wherein the developer used in said developing device is one-component magnetic toner.

12. The developing device according to claim 11, wherein development is effected with toner being extended only to that portion of said image bearing member which has a latent image.

13. The developing device according to claim 11, wherein development is effected with toner being caused to jump across the said space between said cylinder and said image bearing member.

14. The developing device according to claim 11, wherein the space between said image bearing member and said developer holding cylinder is maintained at 50 to 500 microns.

15. The developing device according to claim 14, wherein spacers for maintaining constant the space between said developer holding surface of said cylinder and said image bearing member are provided at the opposite ends of said cylinder, and wherein the thickness of spacers is set to said 50 to 500 microns.

16. The developing device according to claim 1, wherein said developer holding cylinder comprises a non-magnetic sleeve and a magnet roller.

17. The developing device according to claim 1, wherein said developer holding cylinder comprises a magnet roller alone.

* * * * *